US009539709B2

(12) United States Patent
Campoli

(10) Patent No.: US 9,539,709 B2
(45) Date of Patent: Jan. 10, 2017

(54) HUB PULLER

(71) Applicant: Joseph Richard Campoli, Mishawaka, IN (US)

(72) Inventor: Joseph Richard Campoli, Mishawaka, IN (US)

( * ) Notice: Subject to any disclaimer, the term of this patent is extended or adjusted under 35 U.S.C. 154(b) by 0 days.

(21) Appl. No.: 14/814,933

(22) Filed: Jul. 31, 2015

(65) Prior Publication Data

US 2016/0001429 A1 Jan. 7, 2016

Related U.S. Application Data

(63) Continuation of application No. 14/071,527, filed on Nov. 4, 2013, now abandoned.

(51) Int. Cl.
*B25B 27/00* (2006.01)
*B25B 27/02* (2006.01)

(52) U.S. Cl.
CPC ..... *B25B 27/0035* (2013.01); *B25B 27/023* (2013.01); *Y10T 29/49822* (2015.01); *Y10T 29/53891* (2015.01)

(58) Field of Classification Search
CPC .... B25B 27/0035; B25B 27/02; B25B 27/023; B25B 27/062; B23P 19/02; B23P 19/025; Y10T 29/53857; Y10T 29/53891; Y10T 29/49822
See application file for complete search history.

(56) References Cited

U.S. PATENT DOCUMENTS 1,355,028 A * 10/1920 Blessing ..... B25B 27/023 29/263
1,631,889 A * 6/1927 Rappley ..... A01F 15/08 29/239
1,750,840 A * 3/1930 Grover ..... B25B 27/02 29/264
2,421,324 A * 5/1947 Graham ..... B25B 27/062 29/256
2,623,276 A * 12/1952 Anderson ..... B25B 27/023 29/265
4,210,990 A * 7/1980 Krieger ..... B25B 27/023 29/263
4,771,528 A * 9/1988 Stromberg ..... B25B 27/023 29/259
5,544,402 A * 8/1996 O'Neil ..... B25B 27/02 29/261
2006/0196028 A1* 9/2006 Bergman ..... B25B 27/0035 29/254
2006/0196029 A1* 9/2006 Klann ..... B25B 27/023 29/260
2008/0010800 A1* 1/2008 Bergman ..... B25B 27/0035 29/254
2012/0102704 A1* 5/2012 Barrios ..... B25B 27/023 29/426.5

* cited by examiner

*Primary Examiner* — Christopher M Koehler
(74) *Attorney, Agent, or Firm* — Botkin & Hall, LLP

(57) ABSTRACT

An axle hub puller as provided includes a puller body. The puller body includes at least two counter sink holes and a threaded puller screw hole located in the center. The puller body is operable to removably attach to hub with a plurality of wheel lugs by having the plurality of wheel lugs pass through the plurality of counter sink holes. A puller screw is inserted into the threaded puller screw hole. The puller screw is turned against a hub axle center allowing for the removal of the hub and a brake rotor.

15 Claims, 10 Drawing Sheets

HUB PULLER

CROSS REFERENCE TO RELATED APPLICATIONS

This application is a Continuation-in-Part of U.S. application Ser. No. 14/071,527, filed Nov. 4, 2013, the disclosure of which is hereby incorporated by reference.

BACKGROUND OF THE INVENTION

The present invention relates to the removal of hubs and, more particularly, to an axle hub puller. Current devices available that pull a front axle hub off are weak, hard to use, and can damage the hub during removal. These devices are of poor quality and design. Situations occur where the puller may bind on the axle shaft. Frequently, the mounting portion of the hub will corrode and seize to part of the suspension, commonly called the steering knuckle or axle housing. When the user attempts to pull on the hub or bearing assembly out, it separates into two pieces, ruining it. As can be seen, there is a need for an axle hub puller that provides a smooth and equal pulling force on the hub that may keep it from binding on the axle shaft during the removal.

SUMMARY OF THE INVENTION

The present disclosure describes an axle hub puller with a puller body comprising at least two counter sink holes and a threaded puller screw hole. The counter sink holes are sized to fit over existing lug studs that are commonplace on a hub assembly. The puller body attaches to the wheel lugs through counter sink holes. Further, a clamping mechanism fits over a rotating portion of the hub and to a fixed portion of the hub. By tightening down screws in the clamping mechanism, the rotating portion is secured to the fixed portion, preventing the two from separating. The puller screw is turned in against a hub axle center through the puller screw hole, driving the hub from its attachment on the vehicle. These and other features, aspects and advantages of the present invention will become better understood with reference to the following drawings, description and claims.

BRIEF DESCRIPTION OF THE DRAWINGS

A preferred embodiment of this invention has been chosen wherein.

DESCRIPTION OF THE PREFERRED EMBODIMENT

Figure 1:
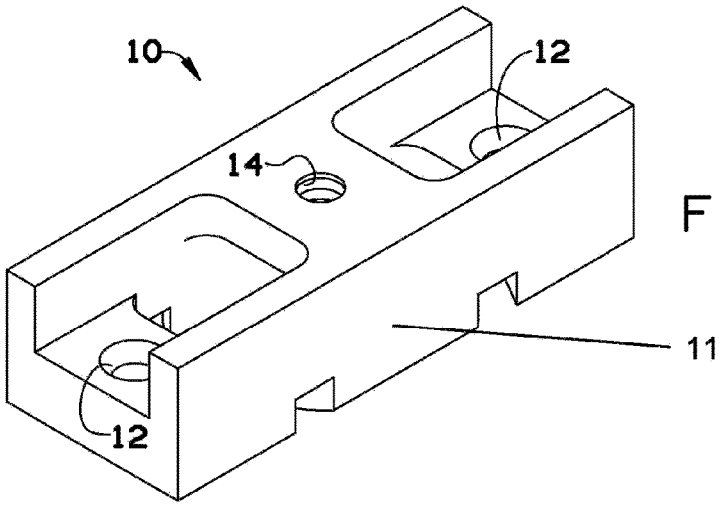
FIG. 1 is an isometric view of the puller body.
Figure 2:
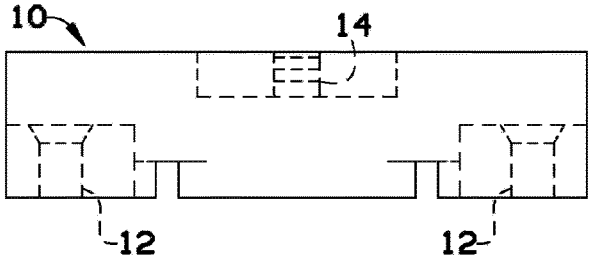
FIG. 2 is a side view of the puller body.
Figure 3:
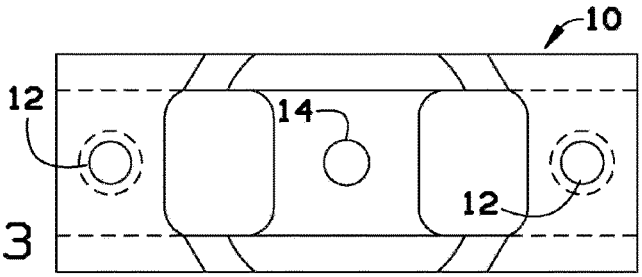
FIG. 3 is a bottom view the puller body.
Figure 4:
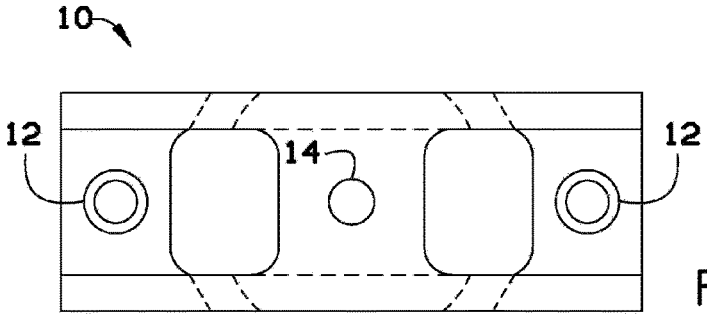
FIG. 4 is a top view of the puller body.
Figure 5:
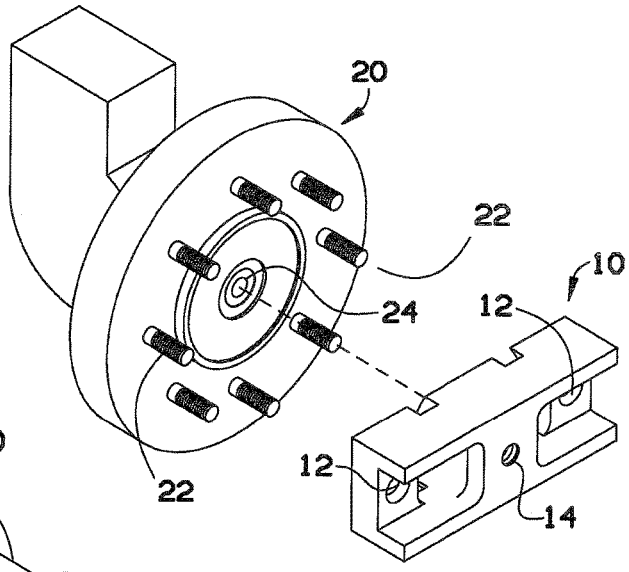
FIG. 5 is an isometric view the puller body being installed on a hub.
Figure 6:
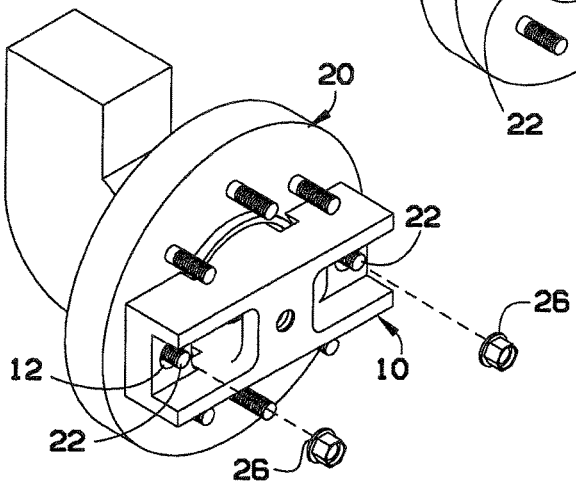
FIG. 6 is an isometric view of the puller body as placed on the hub.
Figure 7:
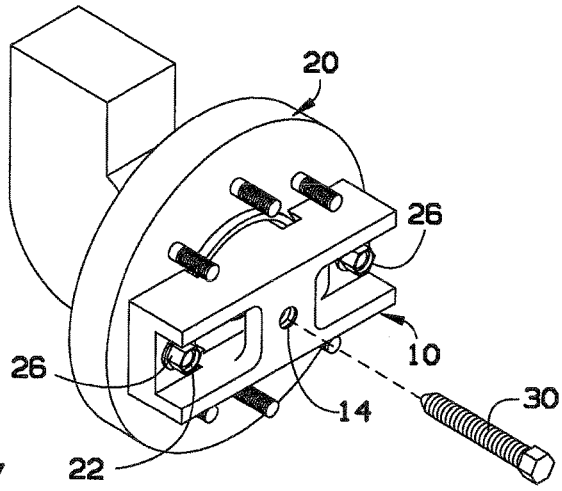
FIG. 7 is an isometric view of the puller body affixed to the hub.
Figure 8:
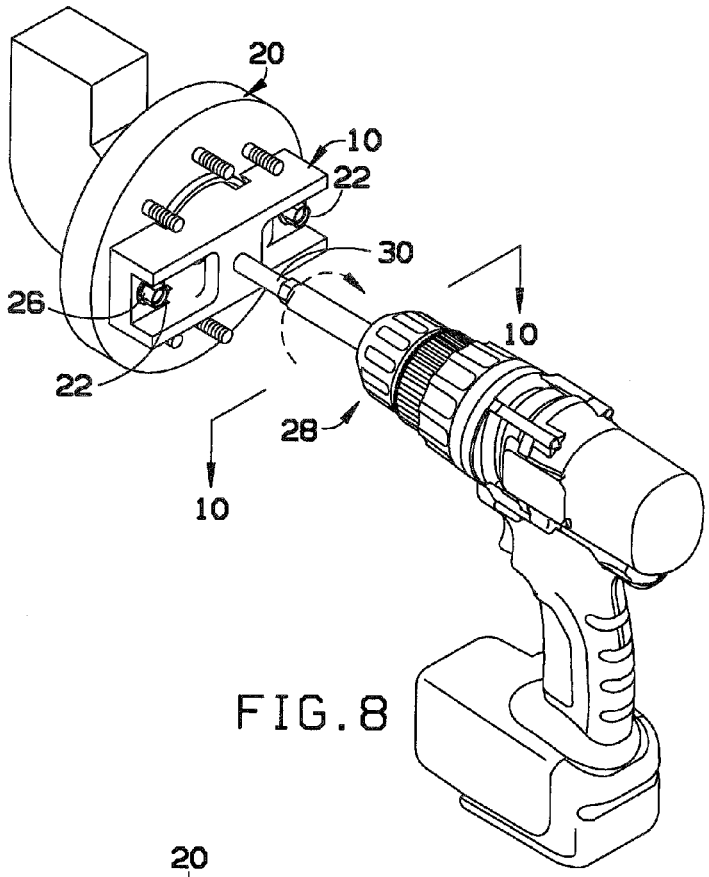
FIG. 8 is a perspective view of an exemplary embodiment of the present invention demonstrating the interface between an exemplary drill and a puller screw.
Figure 9:
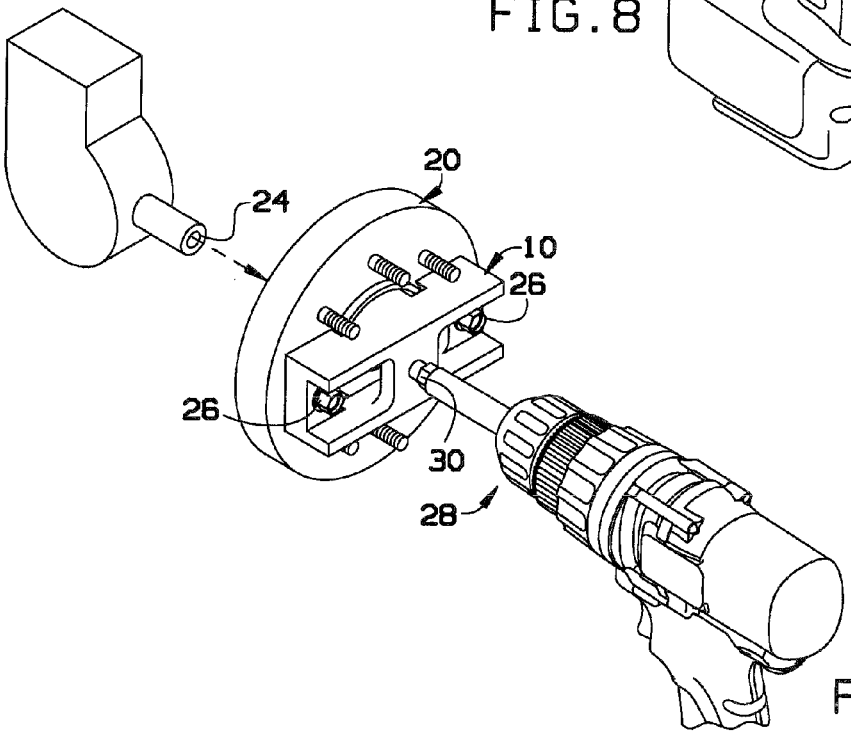
FIG. 9 is an exploded view of an exemplary embodiment of the present invention demonstrating the removal of an exemplary hub.
Figure 10:
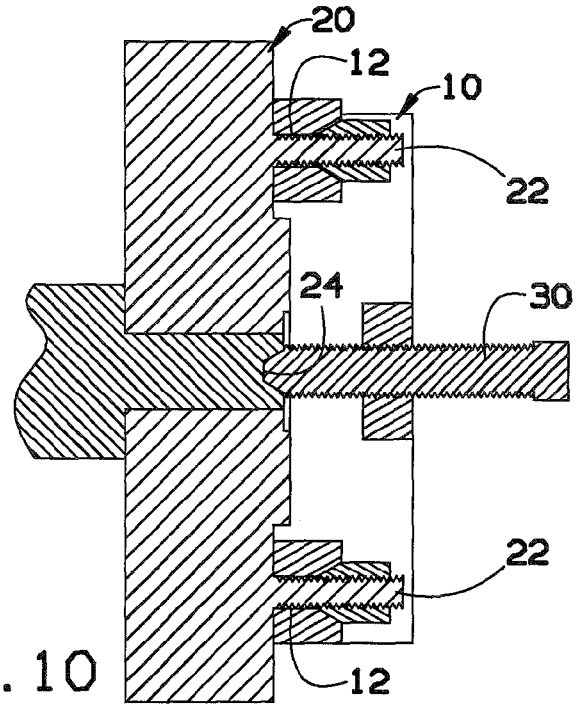
FIG. 10 is a section detail view of an exemplary embodiment of the present invention along line 10-10 in FIG. 8.
Figure 11:
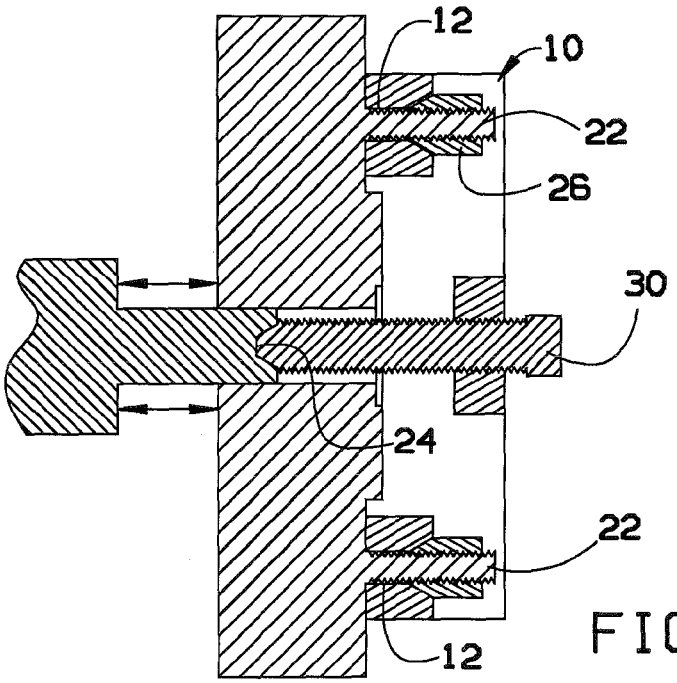
FIG. 11 is a section detail view of an exemplary embodiment of the present invention demonstrating the removal of an exemplary hub.

The present invention is an axle hub pulling system that includes a puller body 10 and a clamping retainer 40. The puller body 10 includes a plurality of counter sink holes 12 and a threaded puller screw hole 14. The puller body 10 as shown in FIGS. 6 through 9 attach to a hub with a plurality of wheel lugs 22 by having wheel lugs pass through the counter sink holes 12. The embodiment as shown has counter sink holes, but a standard hole is contemplated. A puller screw 30 is inserted into the threaded puller screw hole 14. The puller screw is turned against a hub axle center 24 allowing for the removal of the hub and a brake rotor.

Figure 12:
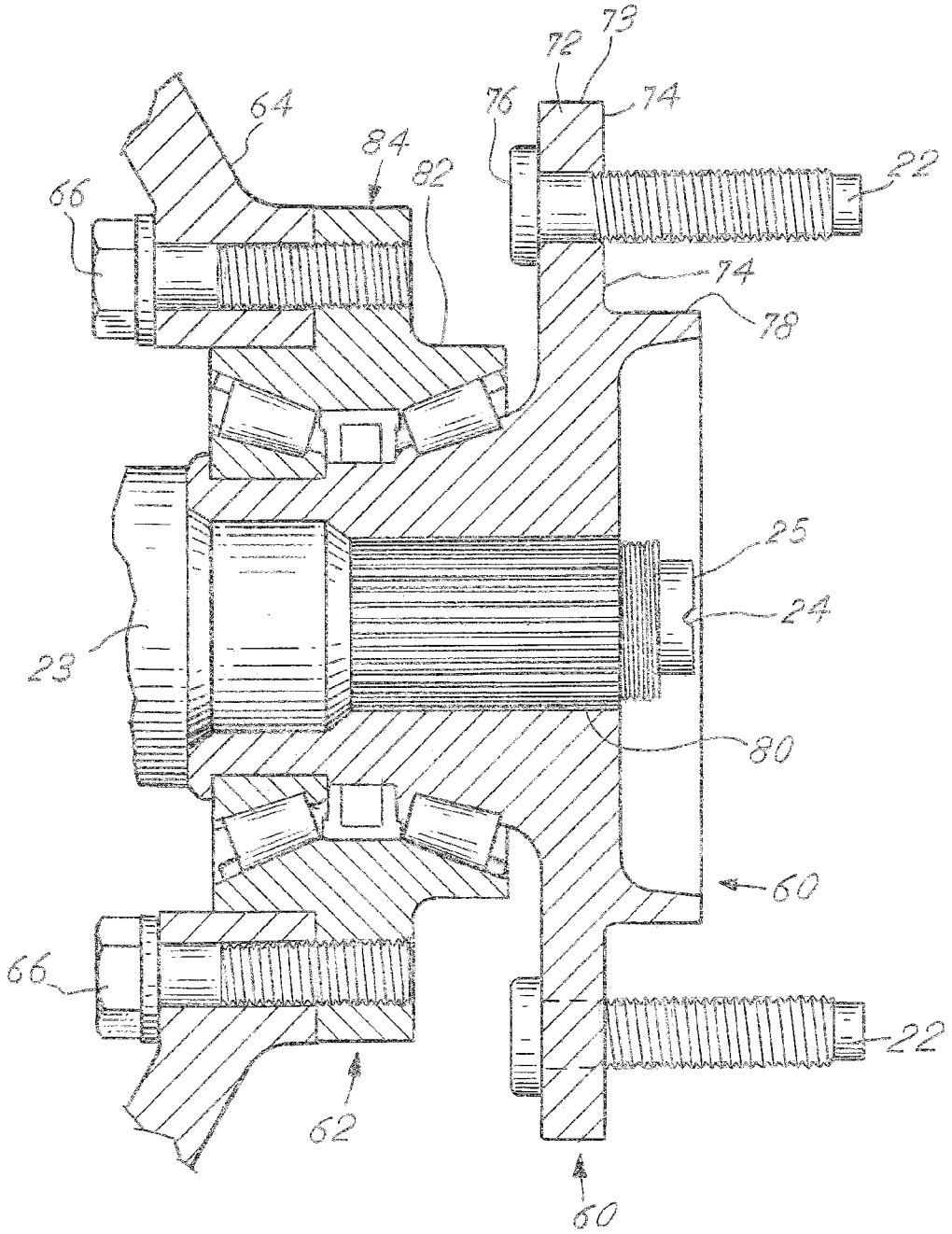
FIG. 12 is a section view of a hub as affixed to a vehicle.

A hub 20 as shown in FIG. 12, has a rotating portion 60 and a fixed portion 62. The fixed portion 62 is affixed to an axle housing 64, suspension, or other powertrain component through bolts 66. The fixed portion 62 typically has a pilot diameter 68 that mates with an inside diameter 70 on the axle housing 64. The rotating portion 60 has a flange portion 72 where lugs 22 extend outwardly. The flange portion 72 has an outside diameter 73. It is contemplated that the flange portion 72 has threaded holes instead of lugs 22 as is common in some European vehicles. The flange portion has an outboard surface 74 that is parallel to an inboard surface 76. In the event that the hub 20 has lugs 22, the rearmost surface of the individual lugs form the inboard surface 76. Towards the center of the hub 20 is a pilot diameter 78 that extends outwardly from the outboard surface 74. The pilot diameter 78 is typically used to center a wheel when it is affixed to the hub 20. In the direct center of the hub is a splined hole 80 where an axle shaft 23 protrudes through. The axle shaft 23 terminates at an end surface 25 that typically has a center 24. The center 24 is a depression in the end surface 25. A nut (not shown) normally holds the axle shaft 23 to the rotating portion 60. The fixed portion 62 of the hub 20 further includes an external diameter 82 that is adjacent to a mounting flange 84. The mounting flange 84 receives the bolts 66 and clamps the fixed portion 62 to the axle housing 64.

As is illustrated in FIGS. 1 through 11, the axle hub puller includes a puller body 10. The puller body 10 as shown has two counter sink holes 12 along with a threaded puller screw hole 14. It is contemplated that additional counter sink holes 12 are implemented, such as would be required for a hub that having an odd number of lugs 22. It is further contemplated that the hole is slotted to allow different hub diameters to be used with the puller body 10. The puller body 10 may have a cutout area 11 that allows clearance between the puller body 10 and the pilot diameter 78.

Figure 13:
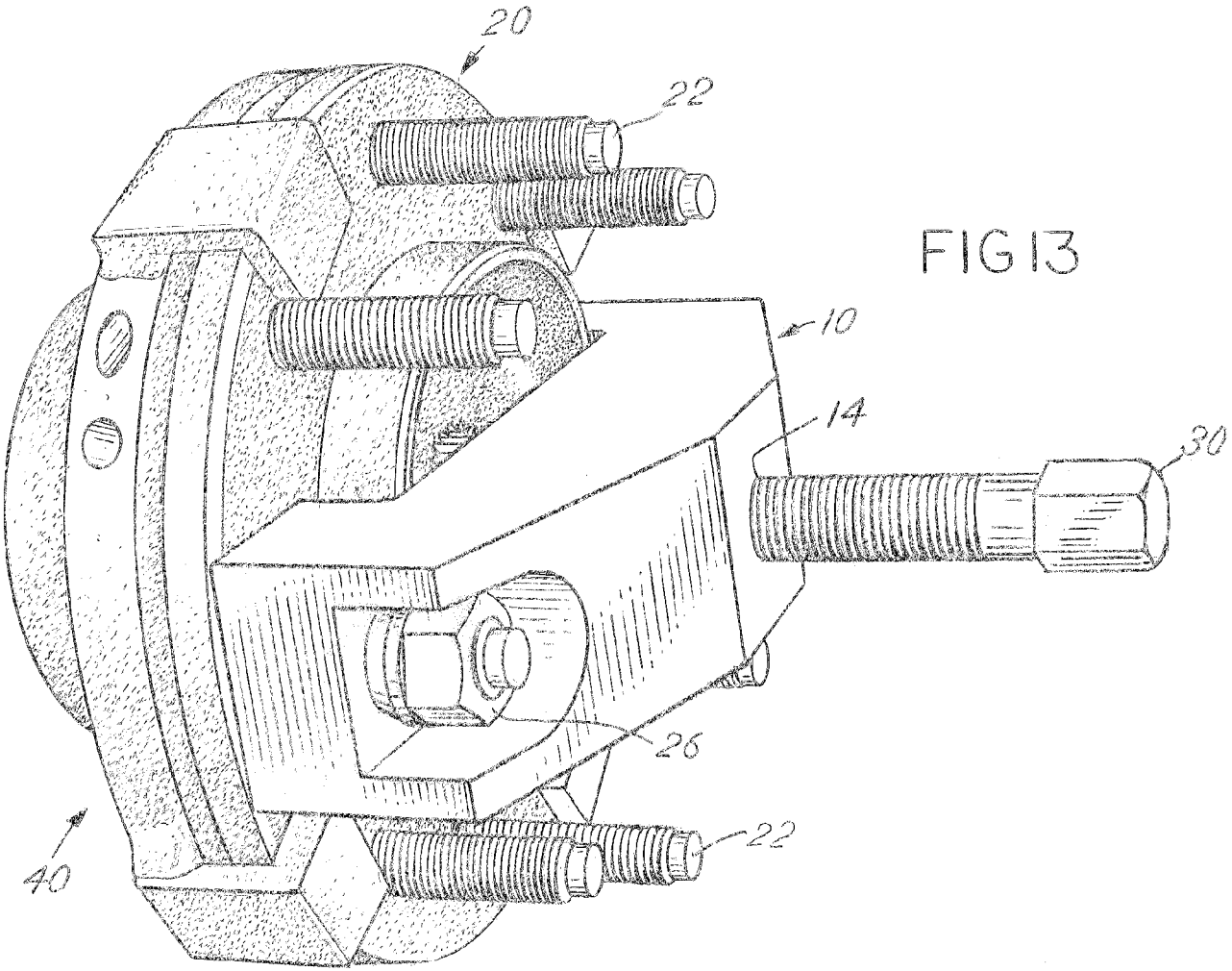
FIG. 13 is an isometric view of the puller system as affixed to a hub.
Figure 14:
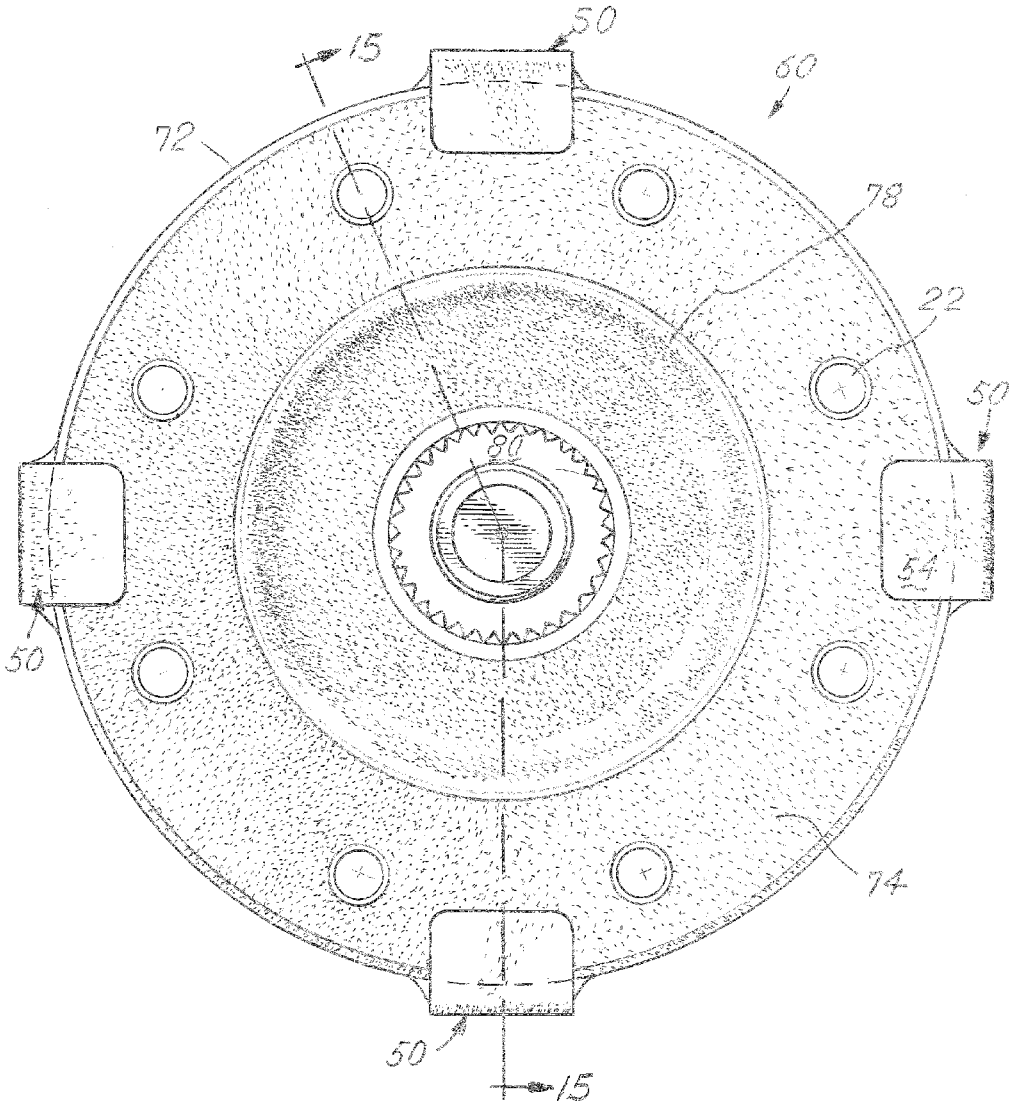
FIG. 14 is a front view of the puller system as affixed to a hub.
Figure 15:
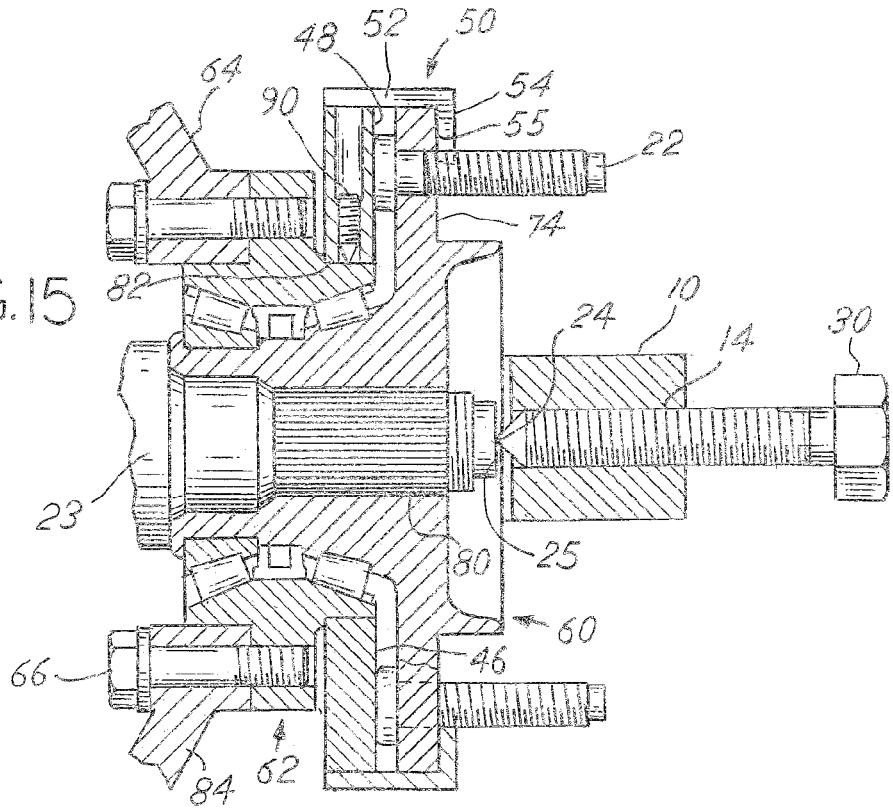
FIG. 15 is a side section 15-15 of the puller system in FIG. 14.
Figure 16:
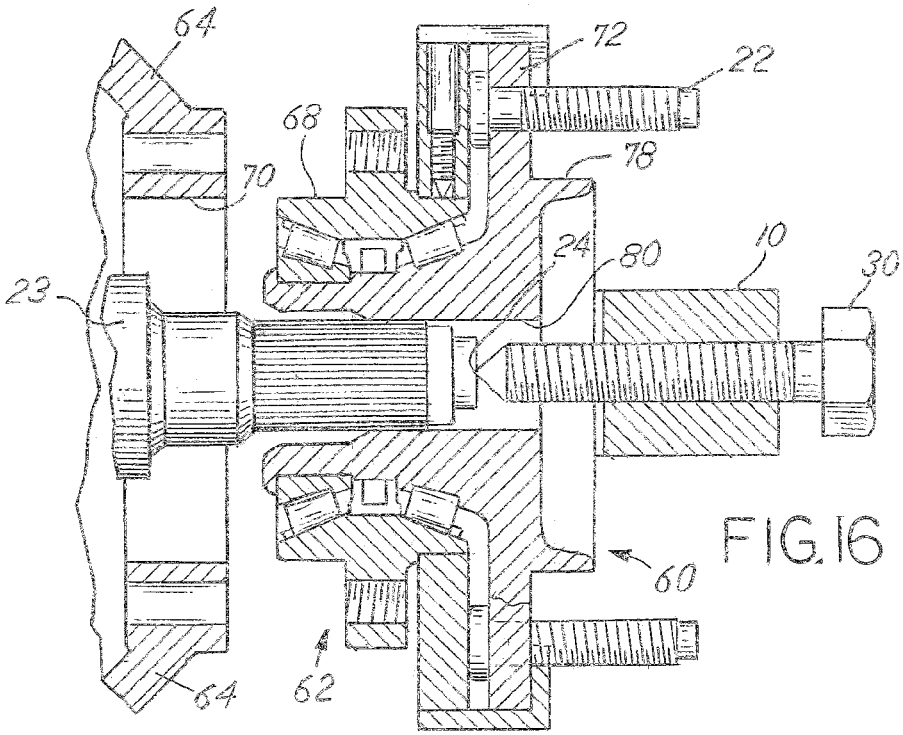
FIG. 16 is a side section of the puller system in FIG. 15 with the hub being removed from the axle housing.
Figure 17:
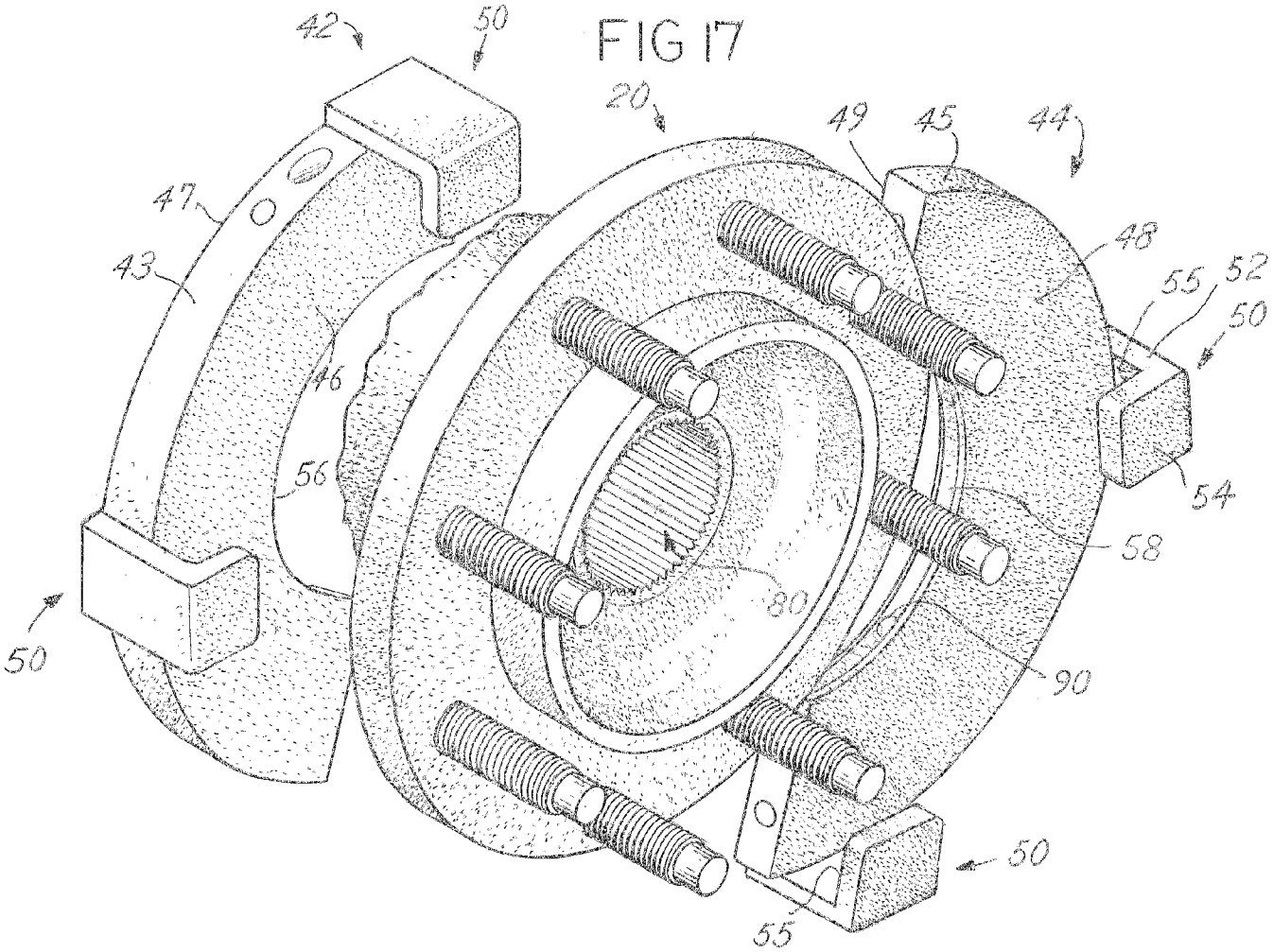
FIG. 17 is an exploded view of the clamping retainer.
Figure 18:
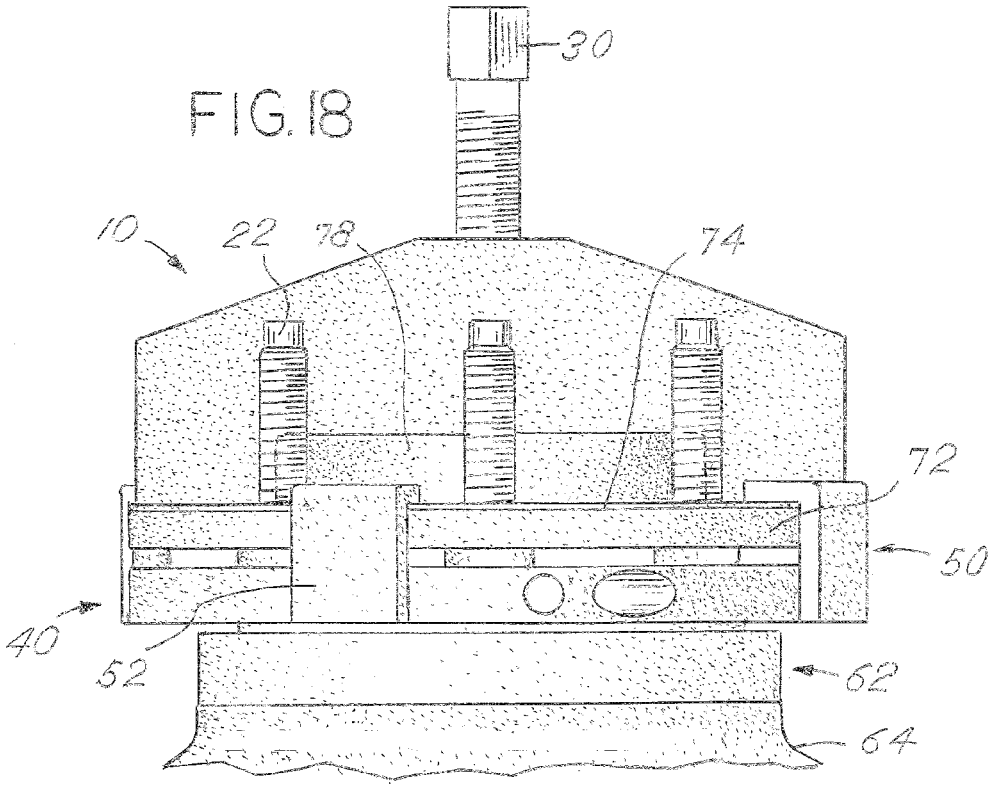
FIG. 18 is a side view of the puller system as affixed to a hub.
Figure 19:
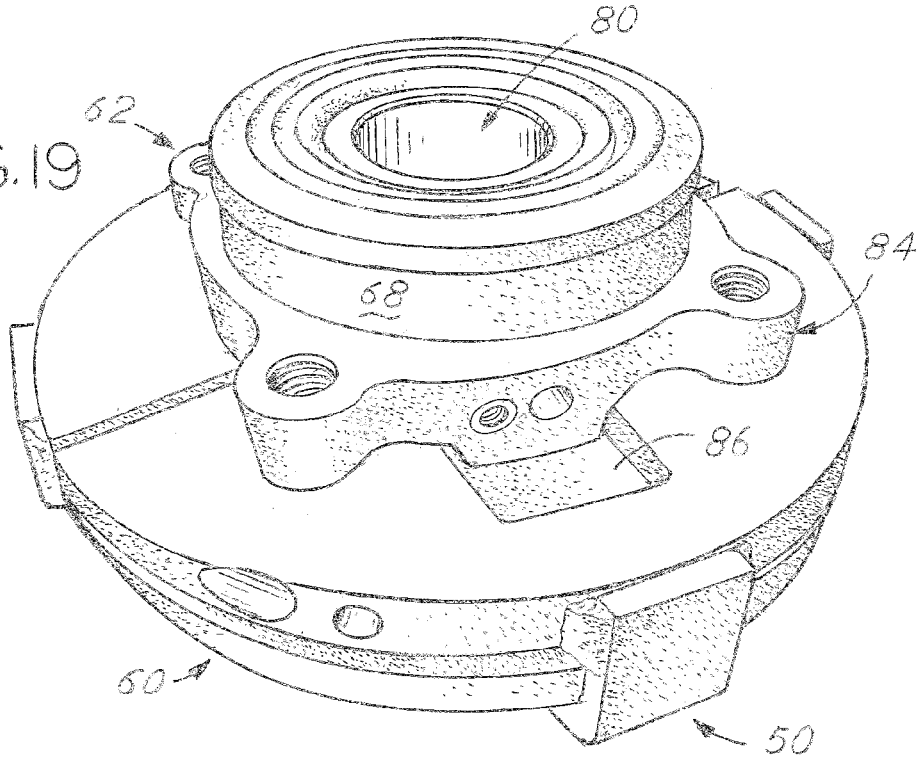
FIG. 19 is a rear isometric view of the puller system as shown in FIG. 13.

The clamping retainer 40, as shown in FIGS. 13 and 17, is two halves. A first half 42 mates to a second half 44 to form the clamping retainer 40. The first half 42 clamps to the second half 44 with screws or other fasteners. The first half 42 as shown is similarly sized as the second half 44, but it contemplated that they are unequally sized. The first half 42 has a lug facing surface 46 and the second half 44 has a lug facing surface 48 that become coplanar when the clamping retainer 40 is fully assembled. Located opposite the lug facing surfaces 46, 48 are axle housing facing surfaces 47, 49 respectively. Extending outward from the lug facing surfaces 46, 48 are retaining tabs 50. As shown in FIG. 17, the retaining tabs 50 are affixed to an outside radius 43, 45. Each retaining tab 50 has an upstanding wall portion 52 and an overhang portion 54 with a hub facing surface 55. The overhang portion 54 is separated from its corresponding lug facing surface 46, 48 by a distance greater than the thickness of the flange 72 to allow the clamping retainer 40 to be installed over the rotating portion 60 of the hub 20. The hub facing surface 55 contacts a portion of the outboard surface 74 of the hub. The first half 42 has an inside radius 56 and the second half 44 has a corresponding inside radius 58 that form a clamping diameter when the clamping retainer 40 is fully assembled. Extending through the first and second half are a series of set screws 90. The set screws 90 are designed to extend through the inside radius 56, 58 when tightened. When the clamping retainer 40 is assembled, the clamping diameter is sized to mate with the external diameter 82 of the fixed portion 62.

Commonly, the fixed portion 62 will have a sensor or other feature that extends outwardly from either the external diameter or the mounting flange 84. The sensor or other feature only occupies a small portion of the fixed portion 62 but can interfere with the clamping retainer 40. To allow clearance for the sensor, the first half 42 has a thinned section 86. The thinned section 86 extends from the axle housing facing surface 47 toward the lug facing surface.

An axle of a car, such as a front axle, is typically exposed by removing a tire, brake caliper, and brake rotor from the axle. The user removes a center axle nut to free the axle shaft 23 from the hub. The hub 20 of the axle having a plurality of wheel axle lugs 22 attached may then be accessed. The puller body 10 is attached to the wheel lugs 22 by placing the counter sink holes 12 over the wheel lugs 22 on the hub 20. A plurality of lug nuts 26 is placed over the plurality of wheel lugs 22 and the plurality of counter sink holes 12 of the puller body 10. The user then tightens the lug nuts 26 securing the puller body 11 to the hub 20. The threaded puller screw hole 14 is positioned over an axle center 24.

As assembled to the hub 20, the upstanding portion 52 of the retaining tabs 50 will be in close proximity to the outside diameter 73 of the flange 72. As shown, the overhang portion 54 extends inwardly toward the pilot diameter 78. Terminal ends of the overhang portion 54 may extend inwardly enough to contact lugs 22.

A puller screw 30 is placed in the threaded puller screw hole 14 and turned. As the puller screw 30 is turned against the axle center 24, the hub 20 and a brake rotor is removed off of the axle together. Turning the puller screw 30 against the axle center 24 creates separation between the hub 20 and the brake rotor from the axle. The puller screw 30 is shown being turned by a drill 28, but can also be turned using an impact socket, wrench, or other device.

The puller body 10 fits across the hub 20 in a way that allows the puller body 10 to be approximately symmetrical across the axle center 24. In the current embodiment, the axle hub puller is made from steel but it is contemplated that other materials can be used. The axle hub can be made from multiple pieces of flat stock steel or formed from a single member. In certain embodiments, five pieces of flat stock steel is used and welded together. Holes are drilled and the center hole is threaded for the puller screw to work within the threaded puller screw hole.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modification is made to the disclosed subject matter as set forth in the following claims.

What is claimed is:

1. A hub removal system adapted for removing a bearing hub having a fixed portion removably affixed to a vehicle and a rotatable portion rotatably affixed to said fixed portion, said fixed portion having an external diameter, said rotatable portion rotatable with respect to said fixed portion about a central axis, said rotatable portion having a flange and a removable axle shaft extending therethrough on said central axis, said system comprising:

a clamping retainer having a first half fixable to a second half, said first half and second half having a lug facing surface, said first half and said second half having a retaining tab extending from said clamping retainer, each said retaining tab having an upstanding wall portion being substantially perpendicular to said lug facing surface and an overhang portion extending substantially perpendicularly from said upstanding wall portion and having a flange facing surface being substantially parallel to and overlaying said lug facing surface;

when said first half is affixed to said second half, said lug facing surface of said first half is substantially coplanar with said lug facing surface of said second half;

said first half having a first inside radius with a first set screw extendable through said first inside radius, said second half having a second inside radius with a second set screw extendable through said second inside radius to contact said fixed portion, said first inside radius and said second inside radius adapted to circumscribe a portion of said external diameter of said fixed portion when said first half is affixed to said second half, said clamping retainer affixing said rotatable portion to said fixed portion when said first and second set screws are in biased contact with said fixed portion; and a puller body adapted to be affixed to said rotating portion and having a flange mating surface, said puller body having at least two counter sink holes extending through said flange mating surface, said counter sink holes adapted to affix said puller body to said flange, said puller body having a threaded hole located substantially between said counter sink holes and being substantially parallel thereto, said threaded hole adapted to receive a puller screw, said threaded hole being substantially aligned with said central axis when said puller body is affixed to said rotatable portion.

2. The hub removal system of claim 1, said fixed portion of said bearing hub having a protrusion extending from said external diameter, said clamping retainer having a thinned section adapted to receive said protrusion.

3. The hub removal system of claim 1, said puller screw adapted to apply compressive force aligned with said central axis to said axle shaft, when said puller screw applies said compressive force, said fixed portion and said rotatable portion are separated from said vehicle.

4. The hub removal system of claim 1, said set screw having a point adapted to partially penetrate a portion of said external diameter to affix said clamping retainer to said bearing hub.

5. The hub removal system of claim 4, said clamping retainer constraining said flange along said central axis.

6. The hub removal system of claim 4, said lug facing surface is adapted to be spaced from said flange mating surface.

7. The hub removal system of claim 6, said puller body having a cutout area adapted to allow a pilot diameter of said rotatable portion to extend through said flange mating surface.

8. A hub removal system adapted for removing a bearing hub having a fixed portion removably affixed to a vehicle and a rotatable portion rotatably affixed to said fixed portion, said fixed portion having an external diameter, said rotatable portion rotatable with respect to said fixed portion about a central axis, said rotatable portion having a flange and a removable axle shaft extending therethrough on said central axis, said system comprising:

a clamping retainer having a first half fixable to a second half, said first half and second half having a lug facing surface, said first half and said second half having a retaining tab extending from said clamping retainer, each said retaining tab having an upstanding wall portion and an overhang portion extending from said upstanding wall portion and having a flange facing surface overlaying said lug facing surface;

when said first half is affixed to said second half, said lug facing surface of said first half is substantially coplanar with said lug facing surface of said second half;

said first half having a first inside radius with a first set screw extendable through said first inside radius, said second half having a second inside radius with a second set screw extendable through said second inside radius to contact said fixed portion, said first inside radius and said second inside radius adapted to circumscribe a portion of said external diameter of said fixed portion when said first half is affixed to said second half, said clamping retainer affixing said rotatable portion to said fixed portion when said first and second set screws are in biased contact with said fixed portion; and a puller body adapted to be affixed to said rotating portion and having a flange mating surface, said puller body having at least two counter sink holes extending through said flange mating surface, said counter sink holes adapted to affix said puller body to said flange, said puller body having a threaded hole located substantially between said counter sink holes and being substantially parallel thereto, said threaded hole adapted to receive a puller screw, said threaded hole being substantially aligned with said central axis when said puller body is affixed to said rotatable portion.

9. The hub removal system of claim 8, said fixed portion of said bearing hub having a protrusion extending from said external diameter, said clamping retainer having a thinned section adapted to receive said protrusion.

10. The hub removal system of claim 8, said upstanding wall portion being substantially perpendicular to said lug facing surface, said overhang portion being substantially perpendicular to said upstanding wall portion.

11. The hub removal system of claim 10, said puller screw adapted to apply compressive force aligned with said central axis to said axle shaft, when said puller screw applies said compressive force, said fixed portion and said rotatable portion are separated from said vehicle.

12. The hub removal system of claim 8, said set screw adapted to partially penetrate a portion of said external diameter to affix said clamping retainer to said bearing hub.

13. The hub removal system of claim 12, said flange having a thickness, said clamping retainer having a gap defined by the distance between said flange facing surface to said lug facing surface, said gap being greater than said thickness.

14. The hub removal system of claim 12, said lug facing surface is adapted to be spaced from said flange mating surface.

15. The hub removal system of claim 14, said puller body having a cutout area adapted to allow a pilot diameter of said rotatable portion to extend through said flange mating surface.

* * * * *